US007861419B2

(12) United States Patent
Psimadas et al.

(10) Patent No.: US 7,861,419 B2
(45) Date of Patent: Jan. 4, 2011

(54) ERGONOMIC RAZOR HANDLE PROVIDED WITH AN IMPROVED GRIP

(75) Inventors: Yiannis Psimadas, Vrilissia-Athens (GR); Spiros Gratsias, Kypseli-Athens (GR); Dimitris Efthimiadis, Nea Kypseli-Athens (GR)

(73) Assignee: BIC Violex SA, Anixi-Attiki (GR)

( * ) Notice: Subject to any disclaimer, the term of this patent is extended or adjusted under 35 U.S.C. 154(b) by 438 days.

(21) Appl. No.: 11/994,028

(22) PCT Filed: Jun. 28, 2005

(86) PCT No.: PCT/EP2005/007996

§ 371 (c)(1),
(2), (4) Date: Dec. 27, 2007

(87) PCT Pub. No.: WO2007/000185

PCT Pub. Date: Jan. 4, 2007

(65) Prior Publication Data

US 2009/0113730 A1 May 7, 2009

(51) Int. Cl.
*B26B 21/52* (2006.01)

(52) U.S. Cl. ..... 30/526

(58) Field of Classification Search ..... 30/526–536; D28/48; 16/430
See application file for complete search history.

(56) References Cited

U.S. PATENT DOCUMENTS

| | | | | | |
|---|---|---|---|---|---|
| D23,699 | S | * | 10/1894 | Kampfe | D28/48 |
| D131,940 | S | * | 4/1942 | Van Slyke | D28/48 |
| 2,348,590 | A | * | 5/1944 | Ayotte | 30/534 |
| 3,396,464 | A | * | 8/1968 | Treiss | 30/531 |
| 3,768,162 | A | * | 10/1973 | Perry | D28/48 |
| D229,249 | S | * | 11/1973 | Castelli | D28/48 |
| 4,198,746 | A | * | 4/1980 | Trotta | 30/527 |
| 4,281,455 | A | * | 8/1981 | Dixon et al. | 30/533 |
| 4,403,414 | A | * | 9/1983 | Kiraly et al. | 30/531 |
| 4,446,619 | A | * | 5/1984 | Jacobson | 30/526 |
| 4,635,361 | A | * | 1/1987 | DeMars | 30/535 |
| 4,716,652 | A | * | 1/1988 | Cataudella | 30/535 |
| 4,993,154 | A | * | 2/1991 | Radcliffe | 30/527 |
| 5,027,511 | A | * | 7/1991 | Miller | 30/526 |

(Continued)

FOREIGN PATENT DOCUMENTS

DE 29511444 U1 * 9/1995

(Continued)

*Primary Examiner*—Jason Daniel Prone
(74) *Attorney, Agent, or Firm*—Jones Day

(57) ABSTRACT

A razor handle having a handle first end adjacent a razor head, a handle second end opposite the handle first end, an upper surface, a lower surface, and a handle length extending from the handle first end to the handle second end. The razor handle includes a rigid plastic base portion and a compressible portion. A plurality of ribs formed of the rigid plastic base portion and the compressible portion are included on the upper surface of the handle at the handle first end, each rib of the plurality of ribs having a rib first end, a rib second end, a center disposed at approximately the midpoint between the rib first and second ends, and a rib length extending from the rib first end to the rib second end. In addition, the center of each of the plurality or ribs is longitudinally aligned along the handle length.

16 Claims, 3 Drawing Sheets

U.S. PATENT DOCUMENTS 5,038,472 A * 8/1991 Iderosa ..... 30/527
5,157,834 A * 10/1992 Chen et al. ..... 30/532
D345,821 S * 4/1994 Wonderley ..... D28/48
D392,417 S * 3/1998 Gray ..... D28/48
5,784,785 A * 7/1998 Polites ..... 30/528
5,784,790 A * 7/1998 Carson et al. ..... 30/532
5,855,071 A * 1/1999 Apprille et al. ..... 30/532
D406,393 S * 3/1999 Gray ..... D28/48
5,890,296 A * 4/1999 Metcalf et al. ..... 30/526
6,026,578 A * 2/2000 Brenner ..... 30/537
D476,772 S * 7/2003 Wonderley ..... D28/48
D500,174 S * 12/2004 Gray ..... D28/48
6,854,188 B1 * 2/2005 Wonderley ..... 30/532
D513,442 S * 1/2006 Miyazaki et al. ..... D28/48
D541,474 S * 4/2007 Psimadas et al. ..... D28/48
D587,846 S * 3/2009 Wonderley et al. ..... D28/48
D603,560 S * 11/2009 Micinilio ..... D28/48
D604,457 S * 11/2009 Psimadas et al. ..... D28/48
D619,763 S * 7/2010 Coresh ..... D28/48
D619,764 S * 7/2010 Rhoad ..... D28/48
D619,765 S * 7/2010 Rhoad ..... D28/48
D624,701 S * 9/2010 Jung ..... D28/48
7,805,845 B2 * 10/2010 Kludjian et al. ..... 30/526
2003/0044313 A1 * 3/2003 Lee ..... 422/28
2004/0093735 A1 * 5/2004 Ohtsubo et al. ..... 30/526
2004/0103545 A1 * 6/2004 Dansreau ..... 30/526
2008/0201966 A1 * 8/2008 Psimadas et al. ..... 30/526
2010/0005669 A1 * 1/2010 Winter et al. ..... 30/526
2010/0011584 A1 * 1/2010 Efthimiadis et al. ..... 30/526
2010/0154232 A1 * 6/2010 Reggis ..... 30/526
2010/0175270 A1 * 7/2010 Psimadas et al. ..... 30/526

FOREIGN PATENT DOCUMENTS

EP 1182015 A1 * 2/2002
WO WO 2005090016 A1 * 9/2005
WO WO 2007000183 A1 * 1/2007
WO WO 2007000184 A1 * 1/2007
WO WO 2007000185 A1 * 1/2007

* cited by examiner

ERGONOMIC RAZOR HANDLE PROVIDED WITH AN IMPROVED GRIP

CROSS-REFERENCE TO RELATED APPLICATION

This application is a national stage application of International Application No. PCT/EP2005/007996, filed on Jun. 28, 2005, the entire contents of which are incorporated herein by reference.

BACKGROUND OF THE INVENTION

1. Field of the Invention

Embodiments of the present invention relate to a wet or safety razor. More particularly, embodiments of the present invention relate to an ergonomic handle provided with an improved grip structure for a wet or safety razor.

2. Description of Related Art

Many types of wet or safety razors (referred hereinafter as safety razors) are known in the art. Razors usually comprise a handle portion, at the front end of which a razor blade unit comprising one or more blades is disposed.

The structure of the handle portion is important for an optimal position of the grip, providing an optimal shaving angle to one or more blades with respect to the surface of skin. Gripping pads or ribs have been provided on the surface of the handles.

However, many known types of handles are limited in their gripping properties when the handle is used in a soapy and watery environment. Thus, although the gripping pads or ribs are made from an elastomeric compressible material, their shape and/or size do not facilitate shaving, particularly precision shaving, more particularly when the index finger of the user guides the razor blade unit. When the finger slips on the side of the handle, the blades are pushed laterally, and the user may cut himself.

Although some known types of handles make it possible to obtain a good grip, research is still going on into handles with even better qualities, particularly as regards precision shaving where the index finger has an essential role.

EP-A-0 894 040 discloses a handle provided with an operating device on the upper side of the handle in the vicinity of the razor head. The said operating device is provided with short ribs which are straight on some drawings, and look curved on other drawings.

EP-A-0 402 105 discloses a handle provided with an actuator comprising short ribs on the upper side of the handle in the vicinity of the razor head.

SUMMARY OF THE INVENTION

The applicant has designed new types of handles which are provided with bowed rubber ribs provided on an upper side of the handle in the vicinity of the razor head.

It has been noted in a surprising and unexpected fashion that the use of the new type of handles of the invention allows the razor blade unit to be precisely guided with the result that a very good shaving is obtained on difficult surfaces of the skin such as under the nose.

Accordingly, embodiments of the present invention are directed to a razor handle having a handle first end adjacent a razor head, a handle second end opposite the handle first end, an upper surface, a lower surface, and a handle length extending from the handle first end to the handle second end. The razor handle includes a rigid plastic base portion and a compressible portion. A plurality of ribs formed of the rigid plastic base portion and the compressible portion are included on the upper surface of the handle at the handle first end where each rib of the plurality of ribs has a rib first end, a rib second end, a center disposed at approximately the midpoint between the rib first and second ends, and a rib length that extends from the rib first end to the rib second end. As can be seen in the figures, the center of each of the plurality or ribs is longitudinally aligned along the handle length.

DETAILED DESCRIPTION OF THE-INVENTION

Figure 1:
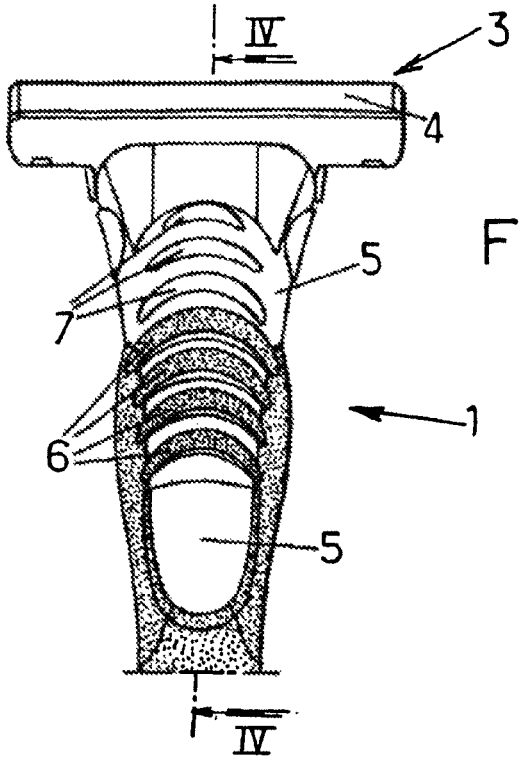
FIG. 1 is a top plan view of the front part of a safety razor in accordance with one embodiment of a handle of the invention.

A subject of an embodiment of the present application is therefore a handle provided with an improved grip structure for a wet or safety razor, comprising a rigid plastic part and a compressible part characterized in that said handle comprises bowed ribs provided on an upper side of the handle in the vicinity of the razor head, the center of which are aligned along the length of the handle and provided backwards.

The bowed ribs may be made of rigid plastic material or preferably of rubber material.

The bowed ribs seen from above look like arcs of a circle, generally of about 70 to 200 degrees of angle, notably between 90 and 180, preferably between 100 and 170, more preferably between 120 and 160.

One or more ribs may have a shape of a full circle. A sucker effect may thus be obtained, providing a further gripping effect to the user during shaving.

The mean radius of such ribs may be from 0.5 to 1.5, preferably from 0.6 to 1.2, more preferably from 0.65 to 1.05 cm.

In the system of embodiments of the present invention, the term "rubber" indicates preferably an elastomeric plastic material, more preferably a mouldable elastomeric material, allowing for ample compression by the user while not requiring an excessive force. Examples of such materials include any elastomeric composition known in the art having any elastomeric hardness range, especially those suitable for making a grip portion, and those that are in the Shore A hardness range. This includes elastomers and thermoplastic elastomers, as well as blends thereof. Suitable elastomers include nitrile rubbers (NBR), styrene butadiene rubbers (SDR), ethylene-propylene terpolymers (EPDM), and (compatible) mixtures thereof. Examples of suitable thermoplastic elastomers include styrene block copolymers, e.g. styrenebutylene block copolymers (SBS), styrene-ethylene-butylene block copolymers (SEBS), thermoplastic polyurethanes, polyether block amides, copolyesters, thermoplastic polyolefins (EPDM/PP, NBR/PP . . . ), and (compatible) blends thereof. Moreover, said elastomeric material may contain one or more additives. Examples of additives include chemicals commonly classed as antioxidants, UV-stabilisers, adhesion modifiers, smell reducers and other such materials that are known to those skilled in the art. Additives improve the processing of said material, enhance its shelf-life and service durability, improve the adhesion to substrate "polymeric supports" that are not inherently inter-compatible and delay inherent sensory defects, such as the inherent typical smell of elastomers and elastomeric compounds.

By "in the vicinity of the razor head", is intended to mean that the whole of the bowed ribs is provided within less than 5.5 cm from the blade or from the rear blade, preferably between 5.2 cm and 1.0 cm, more preferably between 4.9 cm and 1.5 cm, particularly between 4.5 cm and 2.0 cm.

The opening of the arcs may be provided towards the blades. However, in preferential conditions, the opening is provided towards the back of the handle as represented on the figures.

In other preferential conditions, the bowed ribs are provided on a rigid plastic surface of the handle. The number of bowed ribs is from 1 to 12, notably from 2 to 10, preferably 3 to 8, more preferably about 7.

Though the ribs may be provided perpendicular to the surface of the handle, in other preferential conditions, the ribs are slightly inclined towards the front of the handle at an angle of about 75° from the surface of the handle, for example between 60° and 80°.

The height of each rib may be constant. However, under preferred conditions for implementing the invention, the height of a given rib progressively decreases from a greater height at about the middle of the handle seen from above, to a smaller height as the rib extends outwards.

The height of each rib may be constant. However, under preferred conditions for implementing the invention, the height of a given rib progressively increases from a lower height at about the middle of the handle seen from above, to a greater height as the rib extends outwards.

The height of the ribs may also be constant. However, under preferred conditions for implementing the invention, the height or the maximum height of each next rib progressively increases from a smaller height backwards of the handle, to a greater height towards the blades.

Under other preferred conditions for implementing the invention, the height or the maximum height of each next rib progressively decreases from a greater height backwards of the handle, to a lower height towards the blades.

The length of the ribs may be constant. However, under other preferred conditions for implementing the invention, the length of each rib progressively increases from a smaller length backwards of the handle, to a greater length towards the blades. The greater length may be about 150% of the smaller length. Under other preferred conditions for implementing the invention, the length of each rib progressively increases from a smaller length backwards of the handle, to a greater length towards the blades and then progressively decreases to a smaller length.

The longitudinal spacing between two adjacent ribs is from 1.0 to 3.6, preferably 1.4 to 2.6, notably 1.6 to 2.0 mm.

The longitudinal thickness of a rib is from 1.0 to 4.0, preferably 1.5 to 3.0, more preferably 2 to 2.5 mm.

The applicant has also discovered that the slipping prevention effect of the above bowed ribs may be enhanced by a combination of rigid plastic ribs and of rubber ribs.

A sequence of plastic ribs and of rubber ribs may be provided. Preferably, the ribs are grouped according to the nature of the material used for their manufacture, for example plastic ribs and then rubber ribs.

Under preferred conditions for implementing the invention, rigid plastic bowed ribs are provided on the upper side of the handle close to the razor head, between rubber ribs and a cartridge equipped with the blades. In such a case, the length of each rigid plastic rib preferably progressively decreases from a greater length backwards of the handle, to a smaller length towards the blades.

The general structure of the rigid plastic bowed ribs is preferably the same as that of the rubber ribs.

In other preferential conditions, the number of bowed plastic ribs is from 2 to 4, preferably 3.

In further preferential conditions, the number of bowed rubber ribs is from 3 to 6, preferably 4.

The handle of the invention includes an embodiment that has a composite structure comprising a substantially rigid base of an injected moulded thermoplastic, non elastomeric material and a flexible part made of an injected moulded elastomeric material. Some areas of the surface of the handle are constituted by the non elastomeric material and the others by the elastomeric material.

Under preferred conditions for implementing the invention, the present handle is obtained in a two step process.

A subject of an embodiment of the present invention is also a method for making a razor handle as disclosed above comprising moulding a base portion of a rigid plastic material, and moulding an elastomeric grip portion on said base portion, wherein bowed ribs are provided on the upper side of the handle.

Under preferred conditions for implementing the invention, bowed rubber ribs are provided and channels are provided in the base portion of the handle in the vicinity of the razor head such that the bowed rubber ribs may be created by feeding the elastomeric material from below the plastic rigid surface, through the channel holes opened on the upper surface of the handle. Bowed rubber ribs provided on a rigid plastic surface of the handle are thus obtained.

The handles according to embodiments of the invention have advantageous properties because of the bowed ribs provided on the upper side of the handle in the vicinity of the razor head.

The bowed ribs prevent the index finger from slipping during precision shaving, especially when they are made of rubber.

This slipping prevention effect is enhanced by combining rubber ribs and rigid plastic ribs provided on the upper side of the handle close to the razor head, notably plastic ribs provided between the rubber ribs and a cartridge equipped with the blades.

Also, a handle provided with such an arrangement of bowed ribs shaped and dimensioned as described above provide the user with an improved tactile feel as well, improving the controllability and the grip-ability of the razor especially in wet and humid environments.

A safety razor having a handle, which is shaped as described above, ensures an optimal ergonomic grip by the user during precision shaving.

Preferred conditions for implementing the rubber ribs described above also apply to the other subjects of the invention envisaged above, particularly to the method for making a razor handle as disclosed above.

The scope of the invention can be understood better by referring to the description given below, the aim of which is to explain the advantages of the embodiments of the present invention.

Figure 2:
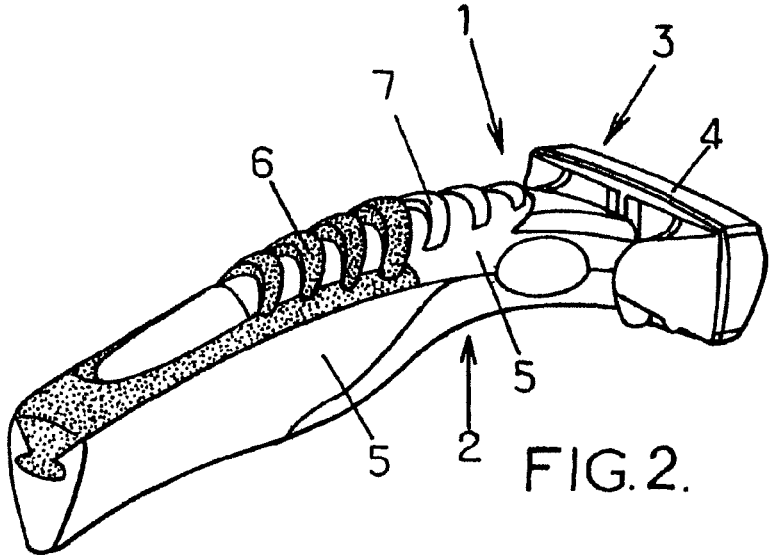
FIG. 2 is a perspective view of the front part of a safety razor in accordance with one embodiment of a handle of the invention.
Figure 3:
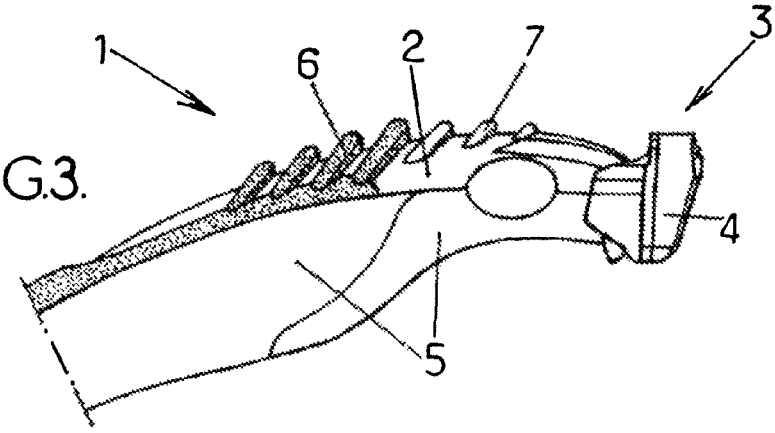
FIG. 3 is a side elevation view of the front part of a safety razor in accordance with one embodiment of a handle of the invention.

Referring to FIGS. 1-3, a safety razor 1 includes a gently curved handle 2 and a razor blade unit 3 having a rigid plastic body 4 provided with multiple blades fixed in the plastic body 4.

The handle 2 comprises a base 5 made of a mouldable rigid plastic material. The handle 2 is provided with a sequence of ribs grouped by nature, four bowed rubber ribs 6 towards the rear of the handle and three bowed rigid plastic ribs 7 towards the front of the handle.

The rubber ribs 6 are made from a mouldable elastomeric material allowing for compression by the user while not requiring an excessive force. Accordingly, the rubber ribs 6 tend to bend and compress and, therefore, to conform to the natural contour of the surface of the index finger to provide a reliable contact between the handle 2 and the user.

As seen on FIG. 1, the bowed rubber ribs 6 and the rigid plastic ribs 7 seen from above look like arcs of a circle, of about 110 degrees of angle, the center of which are aligned along the length of the handle 2.

The opening of the arcs is provided towards the back of the handle.

Their general shape is a crescent. Therefore, the height of a given rib 6,7 progressively decreases from a greater height at about the middle of the handle, to a smaller height as the rib 6,7 extends outwards.

The length of each rigid plastic rib 7 progressively decreases from a greater length backwards of the handle 2, to a smaller length towards the razor blade unit 3, whereas the length of each rubber rib 6 progressively increases from a smaller length backwards of the handle, to a greater length towards the razor blade unit 3.

As seen on FIG. 3, the ribs are slightly inclined towards the front of the handle at an angle of about 75° from the surface of the handle. The maximum height of each next bowed rubber rib 6 progressively increases from a smaller height backwards of the handle, to a greater height towards the blades, and conversely for the rigid plastic ribs 7.

Figure 4:
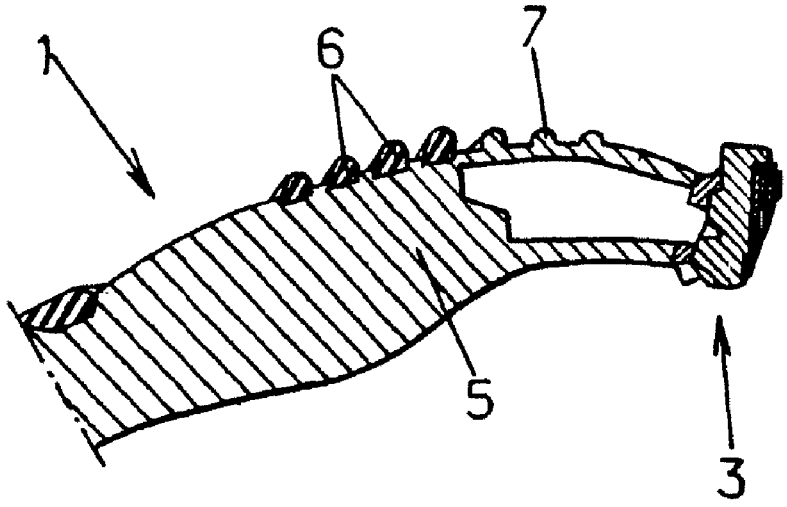
FIG. 4 is a longitudinal cross sectional view of the front part of a safety razor in accordance with one embodiment of a handle of the invention taken along AA' of FIG. 1.

As seen on FIG. 4, the handle 2 comprises a base 5 made of a mouldable rigid plastic material. The handle 2 is provided with a sequence of ribs grouped according to the nature of the material used: four bowed rubber ribs 6 towards the rear of the handle, on the left, and three bowed rigid plastic ribs 7 towards the front of the handle, on the right.

Figure 5:
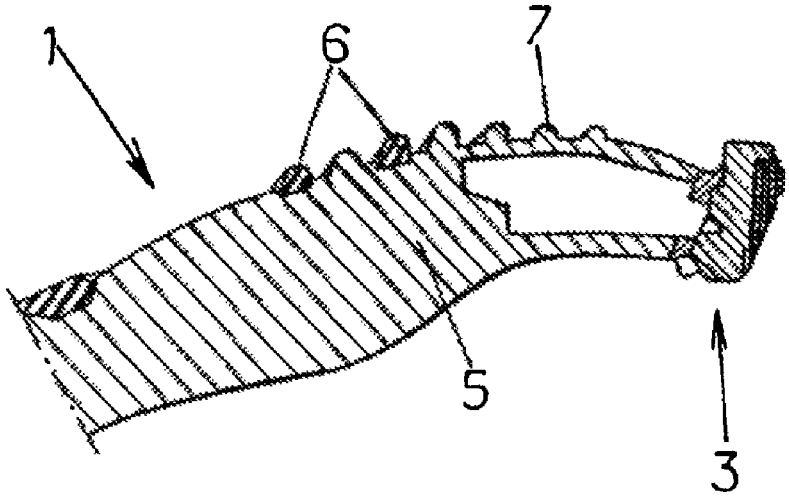
FIG. 5 is a variant of the longitudinal cross sectional view of FIG. 4.
Figure 6:
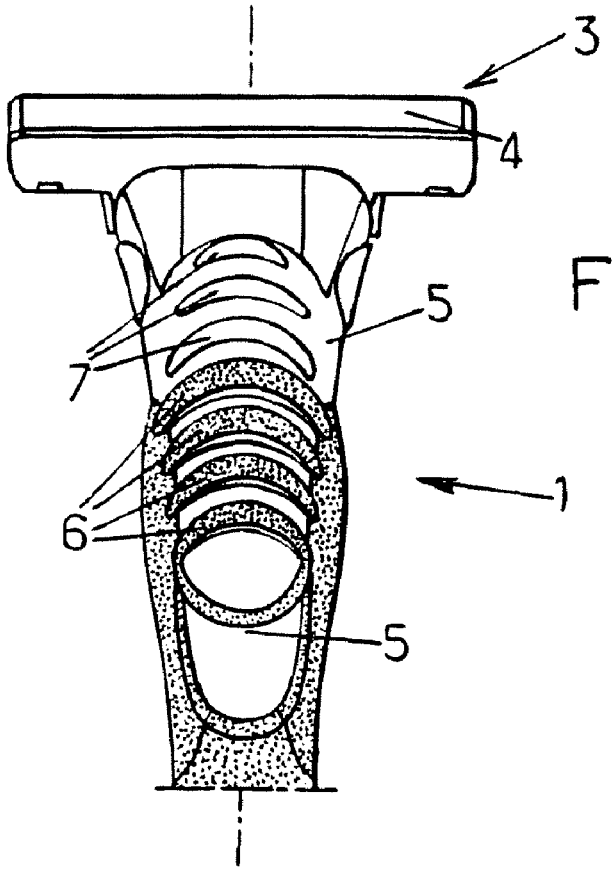
FIG. 6 is a top plan view of the front part of a safety razor in accordance with one embodiment of a handle of the invention.
Figure 7:
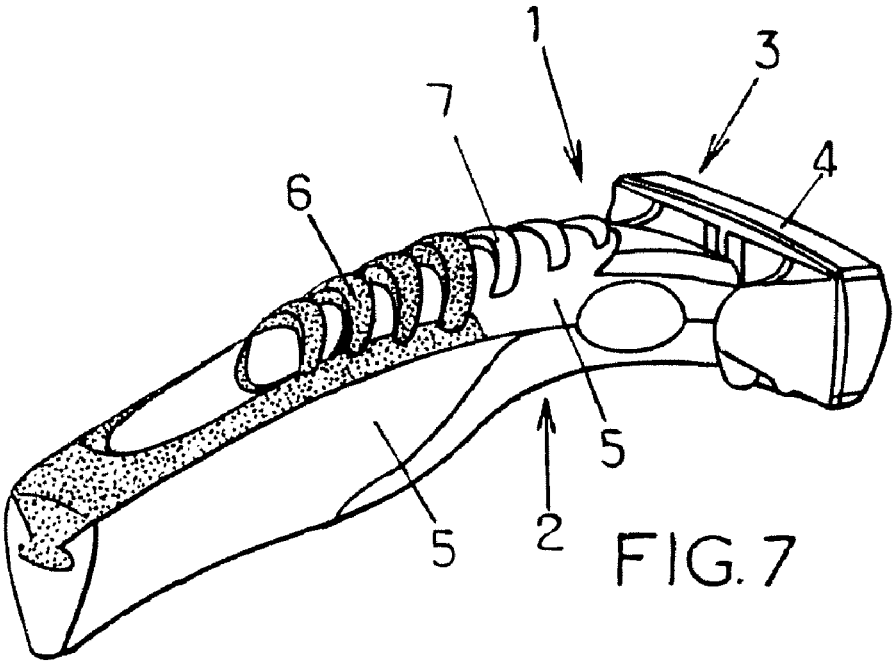
FIG. 7 is a perspective view of the front part of a safety razor in accordance with one embodiment of a handle of the invention.

As seen on FIG. 5, the handle 2 comprises a base 5 made of a mouldable rigid plastic material. The handle 2 is provided with a sequence of ribs but the ribs are not grouped according to the nature of the material used for their manufacture. The four ribs on the left are an alternation of plastic ribs and of rubber ribs whereas the last three ribs on the left all are rigid plastic ribs. The razor blade unit 3 is optimally guided by the index of the user during shaving.

What is claimed is:

1. A razor handle having a handle first end adjacent a razor head, a handle second end opposite the handle first end, an upper surface, a lower surface, and a handle length extending from the handle first end to the handle second end, the razor handle consisting essentially of:

a rigid plastic base portion; and an elastomeric portion, wherein a plurality of ribs formed of the rigid plastic base portion and the the elastomeric portion are included on the upper surface of the handle at the handle first end, each rib of the plurality of ribs having a rib first end, a rib second end, a center disposed at approximately the midpoint between the rib first and second ends, and a rib length extending from the rib first end to the rib second end, wherein the center of each of the plurality or ribs is longitudinally aligned along the handle length.

2. The razor handle according to claim 1, wherein each of the plurality of ribs forms an arc that extends from the rib first end to the rib second end, wherein the arc of each of the plurality of ribs forms an interior angle defined by each rib first end and each rib second end, and wherein the interior angle ranges between about 70 to 200 degrees.

3. The razor handle according to claim 2, wherein each of the plurality of ribs opens towards the handle second end.

4. The razor handle according to claim 3, wherein a number of the plurality of ribs is 7.

5. The razor handle according to claim 2, wherein the plurality of ribs are slightly inclined towards the handle first end.

6. The razor handle according to claim 2, wherein a height above the top surface of each of the plurality of ribs along the rib length is a maximum at the center and a minimum at the rib first end and the rib second end.

7. The razor handle according to claim 2, wherein the rib length of each of the plurality of ribs progressively increases along the handle length from a shorter rib length towards the handle first and second ends, to a longer rib length between the shorter rib lengths.

8. The razor handle according to claim 2, wherein a longitudinal spacing between each of the plurality of ribs is from 1.0 to 3.6 mm.

9. The razor handle according to claim 2, wherein a longitudinal thickness of each of the plurality of ribs is from 1.0 to 4.0 mm.

10. The razor handle according to claim 2, wherein the plurality of ribs comprises a plurality of rigid ribs and a plurality of elastomeric ribs.

11. The razor handle according to claim 1, wherein at least one of the plurality of ribs forms a circle.

12. The razor handle according to any one of claims 1-11, wherein a mean radius of each of the plurality of ribs is from 0.5 to 1.5 cm.

13. The razor handle according to claim 12, wherein the plurality of ribs is adjacent to the handle first end.

14. The razor handle according to claim 1, wherein the rigid plastic base portion comprises an injection molded thermoplastic material and wherein the elastomeric portion comprises an injection molded elastomeric material.

15. A razor handle having a handle first end adjacent a razor head, a handle second end opposite the handle first end, an upper surface, a lower surface, and a handle length extending from the handle first end to the handle second end, the razor handle consisting essentially of:

a rigid plastic base portion; and an elastomeric portion, wherein a plurality of ribs formed of the rigid plastic base portion and the elastomeric portion are included on the upper surface of the handle at the handle first end, each rib having a rib first end, a rib second end, a center disposed at approximately the midpoint between the rib first and second ends, and a rib length extending along an arc from the rib first end to the rib second end, the arc opening towards the handle second end, wherein the center of each of the plurality or ribs is longitudinally aligned along the length of the handle.

16. A razor handle having an improved grip structure, the razor handle comprising:

a handle first end adjacent a razor head;

a handle second end opposite the handle first end;

an upper surface;

a lower surface;

a length extending from the handle first end to the handle second end;

a rigid plastic base portion;

an elastomeric portion; and a plurality of ribs fowled of the rigid plastic base portion and the elastomeric portion and included on the upper surface of the handle at the handle first end, each rib having a rib first end, a rib second end, and a center disposed at approximately the midpoint between the rib first and second ends, each rib of the plurality of ribs forming an arc that opens towards the handle second end and that extends from the rib first end to the rib second end, wherein the center of each of the plurality or ribs is longitudinally aligned along the length of the handle, wherein the arc of each of the plurality of ribs forms an interior angle from each rib first end to each rib second end between about 70 to 200 degrees, and wherein at least one of the plurality of ribs formed of the rigid plastic base portion alternates with at least one of the plurality of ribs formed of the elastomeric portion.

* * * * *